United States Patent [19]

Simon

[11] 4,036,604

[45] July 19, 1977

[54] FUEL

[76] Inventor: David L. Simon, 120 Dawn Drive, Centerreach, N.Y. 11720

[21] Appl. No.: 497,135

[22] Filed: Aug. 13, 1974

[51] Int. Cl.[2] ..... C10L 1/18

[52] U.S. Cl. ..... 44/53; 44/56; 44/62

[58] Field of Search ..... 44/53, 56, 62

[56] References Cited

U.S. PATENT DOCUMENTS

| | | | |
|---|---|---|---|
| 1,360,872 | 11/1920 | Black | 44/56 |
| 1,420,622 | 6/1922 | Charbonneaux | 44/53 |
| 1,428,885 | 9/1922 | Hayes | 44/56 |
| 1,587,899 | 6/1926 | Carroll | 44/56 |
| 1,610,998 | 12/1926 | Cain | 44/62 |
| 1,770,315 | 7/1930 | Laurent | 44/62 |
| 2,067,384 | 1/1937 | Essick | 44/62 |

*Primary Examiner*—Daniel E. Wyman
*Assistant Examiner*—Mrs. Y. Harris-Smith

[57] ABSTRACT

A process for making a fuel by combining turpentine, alcohol and blending agent and reducing the temperature of a batch to form two separate phases of differing densities, both of which are separately useable as fuels for internal combustion engines. The proportions of combustion favor the denser phase. However, under certain conditions, the less dense phase may be desired. Either phase may also be combined with gasoline to enhance the performance of the gasoline.

14 Claims, No Drawings

FUEL

BACKGROUND OF THE INVENTION

This invention relates to fuels for internal combustion engines and is particularly related to a fuel and a process for making the same by using turpentine (a non-petroleum derivative) as the base raw material and combining it with alcohol in the presence of a blending agent such as ketone to manufacture a fuel.

With the high cost and shortages of gasoline and other petroleum fuels, there has been a long felt need for a non-petroleum fuel for use in internal combustion engines. Various non-petroleum products have been tried, but with little commercial success. The combination of small amounts of turpentine to alcohol for use in oil lamps has been well known. For example, see U.S. Pat. Nos. 31 and 54,060. Another patent that discloses a combination of alcohol and a resin is U.S. Pat. No. 1,469,148. These patents are primarily concerned with the use of the mixture in oil lamps and similar devices. It is not known whether or not they were successfully used in the lamps, however, they could not be used as a fuel for automotive purposes. Firstly, the mixture will tend to separate to some extent, particularly at low temperatures. This will produce a non-uniform mixture of different compositions. However, in order to use a fuel in an internal combustion engine, the composition must be uniform so that the proper fuel-air mixture can be metered by the carburetor, i.e., the carburetor can combine the proper amounts of air with the fuel for efficient combustion to take place. If the composition varied, the carburetor setting (which controls the amount of air mixed with the incoming fuel) would have to be constantly varied as the composition of the fuel varied. This is a difficult and practically impossible situation. Thus, these oil lamp fuels could not practically be used for an internal combustion engine. Also these patents describe mixtures where the amount of alcohol exceed the amount of turpentine. However, with Applicant's fuel, the highest energy levels have been achieved with fuels where the amount of turpentine exceeds the amount of alcohol — sometimes by as much as 3 to 2.

Thus, a high energy, uniform composition fuel combining alcohol and turpentine is provided for internal combustion engines.

SUMMARY OF THE INVENTION

The present invention provides a process for manufacturing a fuel using turpentine and alcohol as basic and major raw materials. The process comprises preparing a batch by mixing at room temperature on a volume basis, 2–8 parts turpentine
1–4 parts alcohol
7–14% of acetone (percentage is based on volumes of the first two componennts, and the amount of acetone being dependant on the type of alcohol used and mixing temperature (ethyl requires less than methyl), and reducing the temperature of the batch to the intended operating temperature of the fuel to cause said batch to separate out into two fuels. The phases are then decanted with each phase being useful as an improved fuel or fuel additive.

DETAILED DESCRIPTION OF THE PRESENT INVENTION

The turpentine used in the present invention may be of the gum type, or stream-distilled type or sulfate type. Its approximate general formula is $C_{10}H_{16}$.

The turpentine is first added to the methyl alcohol (or ethyl alcohol) on a volume basis in the proportion of 2-8 parts of turpentine to 1–4 parts of methyl alcohol. If more turpentine is used (as will be discussed subsequently) more of the more dense phase is produced.

If less turpentine is used, more of the less dense phase is produced.

Acetone is then added to the turpentine-alcohol batch. It is not considered essential that acetone be used as other similar ketones, such as other aldehydes (formaldehyde) or ethers, may also function in its place. Other materials such as ether may also be used. The amount of acetone added, should on a volume basis, range from 7–20%, the high percentage being for methyl alcohol and the lower percentage being for ethyl alcohol.

The batch so prepared is then reduced in temperature to cause it to separate out into two phases one being more dense than the other, both of which provide good substitute fuels of fuel additives as more particularly described by the following examples.

The temperature is reduced to just below the temperature at which the particular fuel will be used. If a fuel is to be used in an automobile, the temperature would be just below the lowest temperature that the automobile would be subject to. If it was to be operated at temperatures of 10° F, then in preparing the batch the temperature would be reduced to below 10° F. The reason for this is that if any further separation took place it would result in two different phases entering the carburetor simultaneously. As previously mentioned, this would cause one phase to be properly combined with the correct amount of air (assuming the carburetor was set for that phase) while the other phase would be improperly carbureted (due to an incorrect fuel-air ratio, the combustion would be inefficient or may even be beyond the combustion limits).

EXAMPLE I 2 parts by volume of ethyl alcohol are mixed with 2 parts by volume of turpentine. 7% parts by volume acetone was then added. The batch was then reduced in temperature to 0° F and separate fuels were formed and separated with the less dense fuel comprising approximately 65% by volume and the more dense phase comprising approximately 35% by volume. (The intended lowest temperature for operation is thus 0° F. The less dense fuel had a density of 0.822 (with water having a density of 1) as compared with approximately 0.813 for the original alcohol, and the more dense fuel had a density of 0.855 as compared with the original turpentine which had a density of 0.871. The fuel was tested by using 0.182 gallons thereof in a 36 HP Volkswagon at 40 miles per hour along a hilly roadway, (The Long Island Expressway East from Exit 62). The car was driven for 6.8 miles and had a fuel ecomony of 37.3 miles/gallon with a top speed going up a hill of 47 miles/hour. The starting at 60° F was good and operation was smooth. These results were repeated within 5%. The carburetor was simply reworked to allow near optimum fuel/air mixture ratio. This fuel was also run on a 101 HP Valiant, 300 HP Mercury automobile and a 2 cycle marine engine with similar results.

EXAMPLE II 0.175 gallons of the more dense phase of example I as used under the same conditions and in the same automobile with similar results. The automobile was driven for 8.1 miles with a fuel economy of 46.2 miles/gallon. The top speed going up a hill was 48 miles/hour. The car had good starting at 60° F and operation was smooth. This test was run twice with 5% repeatibility and was also run on the Valiant, Mercury and the marine engine with similar results.

EXAMPLE III

Example 1 was repeated except that 4 parts by volume of methyl alcohol was used instead of 2 parts and 3 parts by volume of turpentine was used instead of 2 parts. The less dense full, which had a fuel density of 0.821 was tested under the same conditions as in Example 1. 0.183 gallons of the less dense fuel was used with the following results: under a test of 6.6 miles, the fuel economy was 36 miles/gallon the top speed going up hill wad 49 miles/hour. Starting at 60° F was good and operation was smooth.

EXAMPLE IV

Example 1 was repeated, 2 parts of alcohol were used and 3 parts of turpentine were used instead of 2. The less dense fuel had a density of 0.823 and 0.1822 gallons of fuel was used. The test ran 6.3 miles under the same conditions and in the same automobile as in Example 1 with a fuel economy in miles/gallon of 34.5. At a top speed of 46 miles/hour starting was good at 60° F. and operation was smooth.

EXAMPLE V

Example 1 was repeated with the addition of 50% gasoline on a volume basis. The combined fuel density was now 0.765. 0.196 gallons of fuel was used under the same conditions and with the same automobile as in Example 1. The test distance of 6.4 miles with a fuel economy of 32.7 miles/gallon was achieved. Top speed of 50 miles/hour. Starting was good at 60° F and operation was smooth.

EXAMPLE VI

The more dense phase of the fuel of Example IV was used, the density was 0.856. 0.1752 gallons of fuel was used for the test. The automobile was driven 8.3 miles with fuel economy of 47.4 miles/gallon at a top speed of 47 miles/hour. Starting was good at 60+ F and operation was smooth.

EXAMPLE VII

Example III was repeated with the addition of 50% by volume of gasoline. The density was 0.76 and 0.1975 gallons of fuel was used for the test. The test density was 6.4 miles and the fuel economy was 32.5 miles/gallon. Top speed was 50 miles/hour and the starting was good at 60° F and the operation was smooth.

EXAMPLE VIII

Example 1 was repeated with 2 parts of gasoline used instead of 2 parts turpentine. Fuel density was 0.764. Fuel volume was 0.1965. The test distance of 6.3 miles was used and a fuel economy was 32 miles per gallon with a top speed of 48 miles/hour. Starting at 60° F was good and operation was smooth. The same conditions and same automobile was used as in Example 1.

EXAMPLE IX

Example I ws repeated without turpentine. The densiy was 0.813. However, the alcohol alone was not useable because combustion could not be sustained. Starting was extremely poor and operation was stopped.

EXAMPLE X

Example I was repeated without the use of any methyl alcohol The fuel density was 0.871, however, the fuel was not useable because combustion could not be sustained. Starting at 60° F was very poor and operation was very jerky and eventually stopped.

EXAMPLE XI 90 octane gasoline was used under the same conditions and with the same automobile as in Example 1. Fuel density was 0.715. 0.20 gallons of fuel were tested at a distance of 7.9 miles. Fuel economy was 37.9 miles/gallon with top speed of 47 miles/hour. Starting was good at 60° F and operation was smooth.

EXAMPLE XII

A fuel consisting of 10 parts alcohol, 5 parts turps and 8% acetone in accordance with U.S. Pat. No. 1,469,148 was made. The density was 0.825. The fuel proved unuseable because it separated into two fuels which could not be carbureted because they needed different amounts of air as previously explained. The fuels were unuseable and combustion could not be sustained.

All of the above examples were run in the same automobile and also were run on the Valiant, Mercury and the Marine engine with similar results.

It will be appreciated from the above examples that fuels are formed which combust in an equal or superior manner to gasoline.

The exact mechanism of the combination between the alcohol and turpentine in the presence of the blending agent is not fully explainable but it is felt that some kind of reaction has taken place to form the composition. Normally, turpentine and alcohol are not misible however, there is apparently some type of combination formed in the present case.

While specific embodiments of the present invention have been disclosed it will be appreciated that many modifications thereof may be made by one skilled in the art which falls within the true spirit and scope of the invention.

What is claimed is:

1. A process for making an internal combustion engine fuel comprising;

a. preparing a batch by mixing, on a volume basis,

1—8 parts turpentine

1—4 parts alcohol comprising an alcohol from the group of methyl or ethyl alcohol 7—20% of a blending agent from the group comprising an aldehyde or a ketone, and (b) reducing the temperature of the batch to below the intended operating temperature, at most 10° F, of the fuel to cause said batch to separate out into two phases based on density.

2. The process of claim 1 wherein the alcohol is added to the turpentine on a volume basis of one part to two.

3. The process of claim 1 wherein the alcohol is added to the turpentine on a volume basis of four to three.

4. The process of claim 1 wherein the alcohol is added to the turpentine on a volume basis of two parts to three.

5. The process of claim 1 including the step of placing the less dense phase in an internal combustion engine and combusting it.

6. The process of claim 1 including the step of placing the more dense phase in an internal combustion engine and combusting it.

7. The process of claim 1 wherein the blending agent is a ketone.

8. The process of claim 7 wherein the ketone is acetone.

9. The process of claim 1 wherein the blending agent is an aldehyde.

10. The process of claim 1 including the step of adding gasoline to either of the fuel phases.

11. The product of the process of claim 1.

12. The product of the process of claim 2.

13. The product of the process of claim 3.

14. The product of the process of claim 4.

* * * * *